US010207144B2

(12) United States Patent
Huang

(10) Patent No.: US 10,207,144 B2
(45) Date of Patent: Feb. 19, 2019

(54) SUPPORTING APPARATUS FOR TREADMILL

(71) Applicant: REXON INDUSTRIAL CORP., LTD., Taichung (TW)

(72) Inventor: Chiung-Tung Huang, Taichung (TW)

(73) Assignee: REXON INDUSTRIAL CORP., LTD., Taichung (TW)

( * ) Notice: Subject to any disclaimer, the term of this patent is extended or adjusted under 35 U.S.C. 154(b) by 86 days.

(21) Appl. No.: 15/275,539

(22) Filed: Sep. 26, 2016

(65) Prior Publication Data

US 2017/0136291 A1 May 18, 2017

(30) Foreign Application Priority Data

Nov. 18, 2015 (TW) ..... 104138001 A

(51) Int. Cl.
*A63B 22/02* (2006.01)
*A63B 22/20* (2006.01)
*A63B 23/04* (2006.01)

(52) U.S. Cl.
CPC ..... *A63B 22/0207* (2015.10); *A63B 22/20* (2013.01); *A63B 23/0405* (2013.01); *A63B 2210/50* (2013.01)

(58) Field of Classification Search
CPC ..... A63B 21/00058; A63B 21/00069; A63B 21/00072; A63B 21/4027; A63B 21/4033; A63B 21/4034; A63B 21/4047; A63B 22/0015; A63B 22/0023; A63B 22/0046; A63B 22/02; A63B 22/0207; A63B 22/0214; A63B 22/0221; A63B 22/20; A63B 22/201; A63B 22/203; A63B 22/205; A63B 22/208; A63B 23/035; A63B 23/03516; A63B 23/03541; A63B 23/04; A63B 23/0405; A63B 23/047; A63B 23/0482; A63B 23/0494; A63B 69/0028;

(Continued)

(56) References Cited

U.S. PATENT DOCUMENTS 6,923,747 B1 * 8/2005 Chu ..... A63B 22/02 482/54
2004/0087417 A1 * 5/2004 Lo ..... A63B 22/02 482/54

(Continued)

FOREIGN PATENT DOCUMENTS

TW M316743 * 8/2007 ..... A63B 22/02

*Primary Examiner* — Gary D Urbiel Goldner
(74) *Attorney, Agent, or Firm* — Bacon & Thomas, PLLC

(57) ABSTRACT

A supporting apparatus used in a treadmill positioned on a supporting surface and including a base frame, a treadbase pivotally connected to the base frame and biasable between a reclined position and an upright position and a linkage pivotally coupled between the treadbase and the base frame. The base frame includes a supporting shaft inserted through the base frame and slidably supportable on the supporting surface and defining opposing first and second supporting sections that are respectively extended out of two opposite lateral sides of the base frame in such a manner that a length of the first supporting section is greater than a length of the second supporting section when the treadbase is in the reclined position, or smaller than the length of the second supporting section when the treadbase is in the upright position.

6 Claims, 7 Drawing Sheets

(58) Field of Classification Search
CPC ..... A63B 69/0035; A63B 71/0054; A63B 2071/0063; A63B 2071/0072; A63B 2071/0081; A63B 2071/009; A63B 2208/0204; A63B 2208/0209; A63B 2210/00; A63B 2210/10; A63B 2210/50; A63B 2210/58; A63B 2225/09; A63B 2225/093
See application file for complete search history.

(56) References Cited

U.S. PATENT DOCUMENTS

2012/0165161 A1* 6/2012 Chen ..... A63B 22/02 482/54
2012/0165162 A1* 6/2012 Lu ..... A63B 22/0235 482/54
2013/0123073 A1* 5/2013 Olson ..... A63B 22/02 482/54
2013/0143721 A1* 6/2013 Dalebout ..... A63B 22/0002 482/54
2013/0203560 A1* 8/2013 Wang ..... A63B 22/0023 482/54
2013/0203561 A1* 8/2013 Lee ..... A63B 22/0235 482/54
2013/0237382 A1* 9/2013 Huang ..... A63B 22/02 482/54
2013/0237384 A1* 9/2013 Huang ..... A63B 22/02 482/54
2013/0267386 A1* 10/2013 Her ..... A63B 22/02 482/54
2014/0073488 A1* 3/2014 Wu ..... A63B 22/02 482/54
2014/0080678 A1* 3/2014 Wu ..... A63B 22/02 482/54
2014/0121066 A1* 5/2014 Huang ..... A63B 22/02 482/54
2014/0121067 A1* 5/2014 Huang ..... A63B 22/0235 482/54
2014/0221167 A1* 8/2014 Wu ..... A63B 22/0023 482/54
2014/0274579 A1* 9/2014 Olson ..... A63B 22/0235 482/54
2015/0051051 A1* 2/2015 Liu ..... A63B 22/02 482/54
2015/0202487 A1* 7/2015 Wu ..... A63B 22/02 482/54
2015/0250304 A1* 9/2015 Dalebout ..... A63B 22/02 482/54
2015/0251048 A1* 9/2015 Dalebout ..... A63B 71/0686 482/54
2015/0352396 A1* 12/2015 Dalebout ..... A63B 21/0442 482/54

* cited by examiner

SUPPORTING APPARATUS FOR TREADMILL

BACKGROUND OF THE INVENTION

1. Field of the Invention

The present invention relates to treadmill technology and more particularly, to a foldable supporting apparatus for treadmill.

2. Description of the Related Art

Referring to FIG. 1, Taiwan Patent M316743 discloses a treadmill 1, which comprises a rectangular base frame 11; a treadbase 12 pivotally mounted at the base frame 11, and a cylinder 13. The base frame 11 comprises two opposing side bars 111, and two end bars 112 connecting the two side bars 111. The treadbase 12 is biasable relative to the base frame 11 between a vertically extended collapsed position and a horizontally extended operating position. The cylinder 13 is pivotally connected between one side bar 111 of the base frame 11 and the treadbase 12, and operable between an extended position and a retracted position. When the treadbase 12 is in the illustrated collapsed position, the cylinder 13 generates a damping force against the treadbase 12.

When the treadbase 12 is biased to the collapsed position, the higher center of gravity of the treadbase 12 can cause treadbase 12 to fall down accidentally. It is a normal way to use a large and protruded part of the base frame 11 for providing stable support to the collapsed treadbase 12. Thus, even if the base frame 11 has an open frame design, the treadmill still has the drawback of large dimension and space occupation.

SUMMARY OF THE INVENTION

The present invention has been accomplished under the circumstances in view. It is the main object of the present invention to provide a supporting apparatus for a treadmill, which has a reduced occupation of space and enables the treadmill to benefit from space utilization.

To achieve this and other objects of the present invention, a supporting apparatus is used in a treadmill that comprises a base frame placed on a supporting surface, a treadbase pivotally mounted at the base frame and biasable relative to the base frame between a reclined position where the treadbase is disposed in proximity to the supporting surface and an upright position where the treadbase is kept far from the supporting surface and a linkage coupled between the treadbase and the base frame. The supporting apparatus comprises a supporting shaft. The supporting shaft is inserted through the base frame and is slidable on the supporting surface relative to the base frame and interlocking with the treadbase. Further, the supporting shaft defines a first supporting section, which is disposed with the treadbase in the reclined position at one lateral side relative to the base frame, and a second supporting section that is extended out of an opposing lateral side of the base frame. Further, the length of the first supporting section of the supporting shaft is greater than the length of the second supporting section when the treadbase is in the reclined position; and the length of the second supporting section is greater than the length of the first supporting section when the treadbase is in the upright position.

This design of changing the lengths of the opposing first and second supporting sections of the supporting shaft subject to the pivoting of the treadbase achieves the effect of supporting the base frame and the treadbase and enhances the stability when using or folding the treadmill.

Other and further advantages and features of the present invention will be understood by reference to the following specification in conjunction with the accompanying drawings.

DETAILED DESCRIPTION OF THE INVENTION

Figure 2:
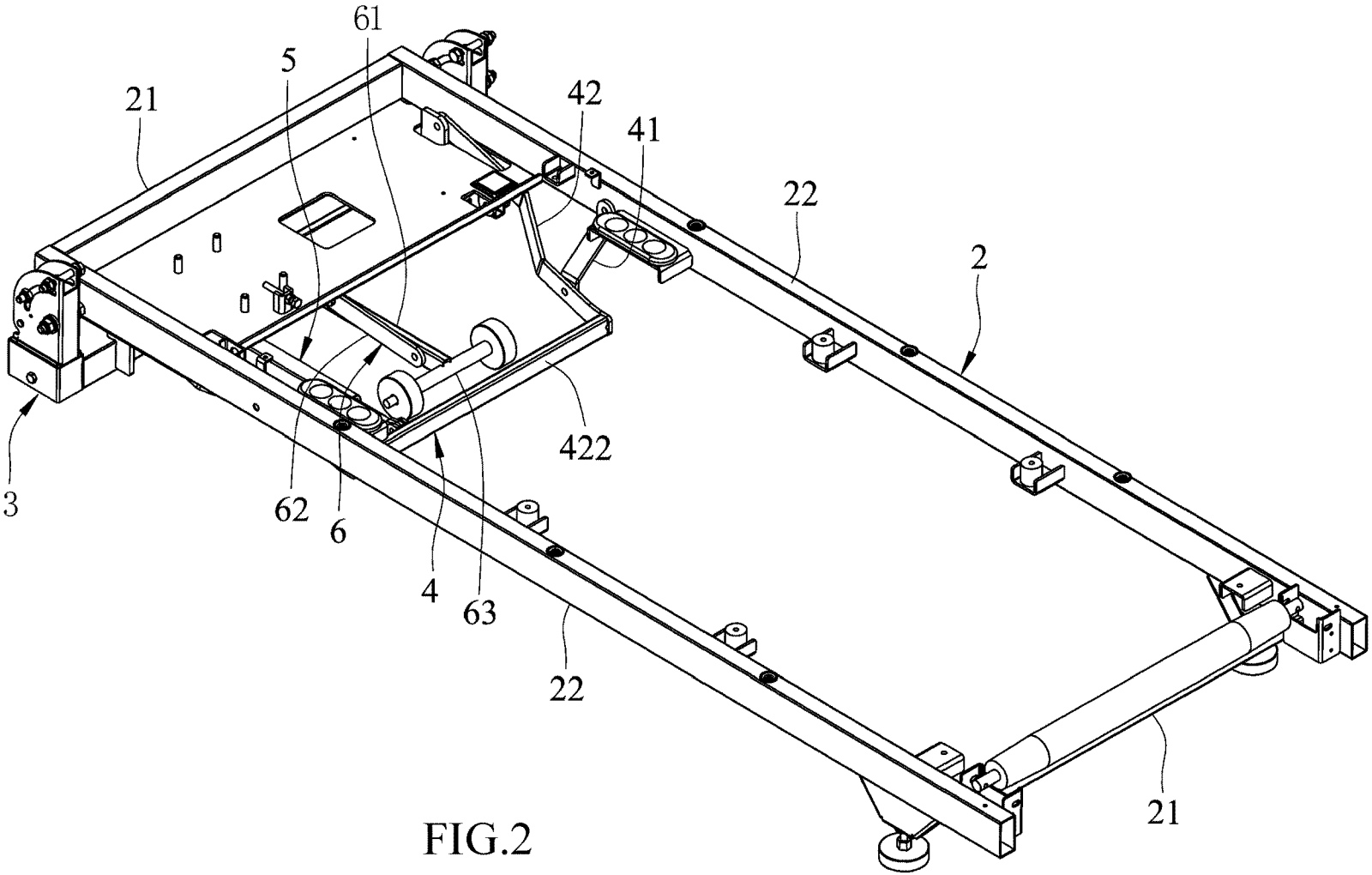
FIG. 2 is a perspective view of a treadmill equipped with a supporting apparatus in accordance with the present invention.
Figure 3:
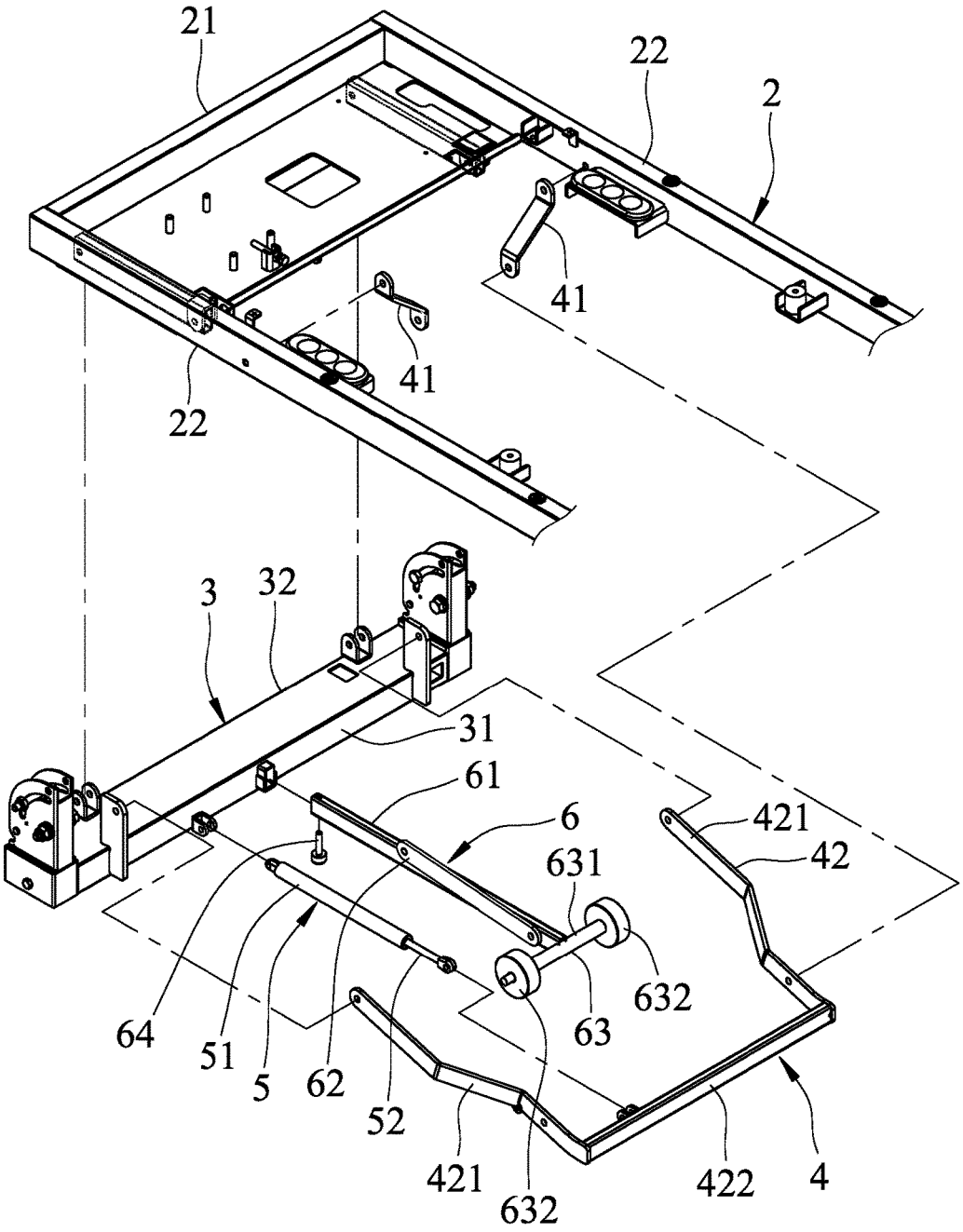
FIG. 3 is an exploded view of the supporting apparatus and a part of the treadmill shown in FIG. 2.
Figure 4:
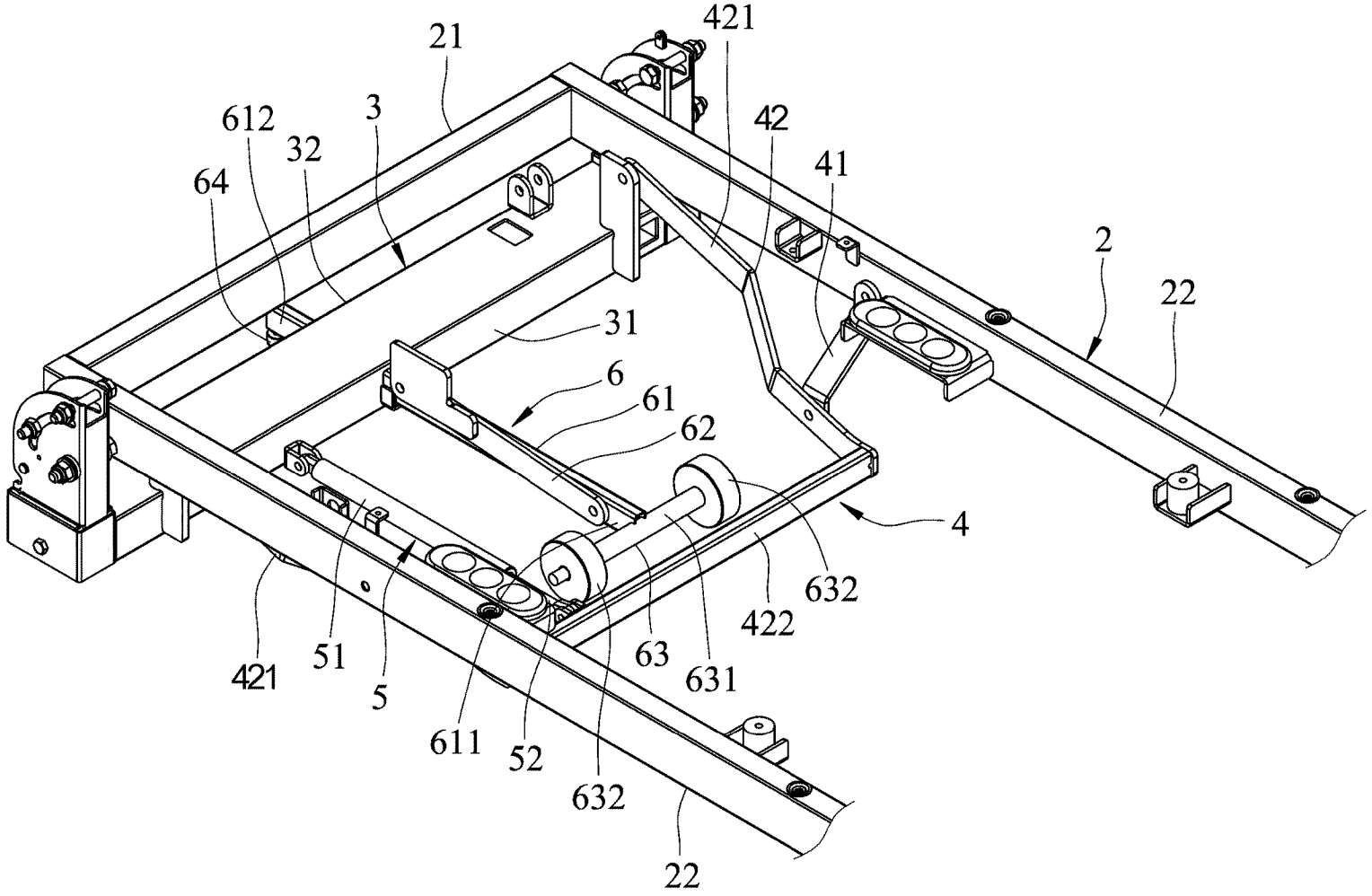
FIG. 4 is a perspective view of a part of the treadmill in accordance with the present invention, illustrating the relationship between the supporting apparatus and the treadmill in the reclined position.

Referring to FIGS. 2, 3 and 4, a supporting apparatus 6 for a treadmill in accordance with the present invention is shown installed on a treadmill. The treadmill comprises a treadbase 2, a base frame 3, a linkage 4 and a retracting device 5.

The treadbase 2 comprises two opposing short sides 21 and two opposing long sides 22.

Figure 5:
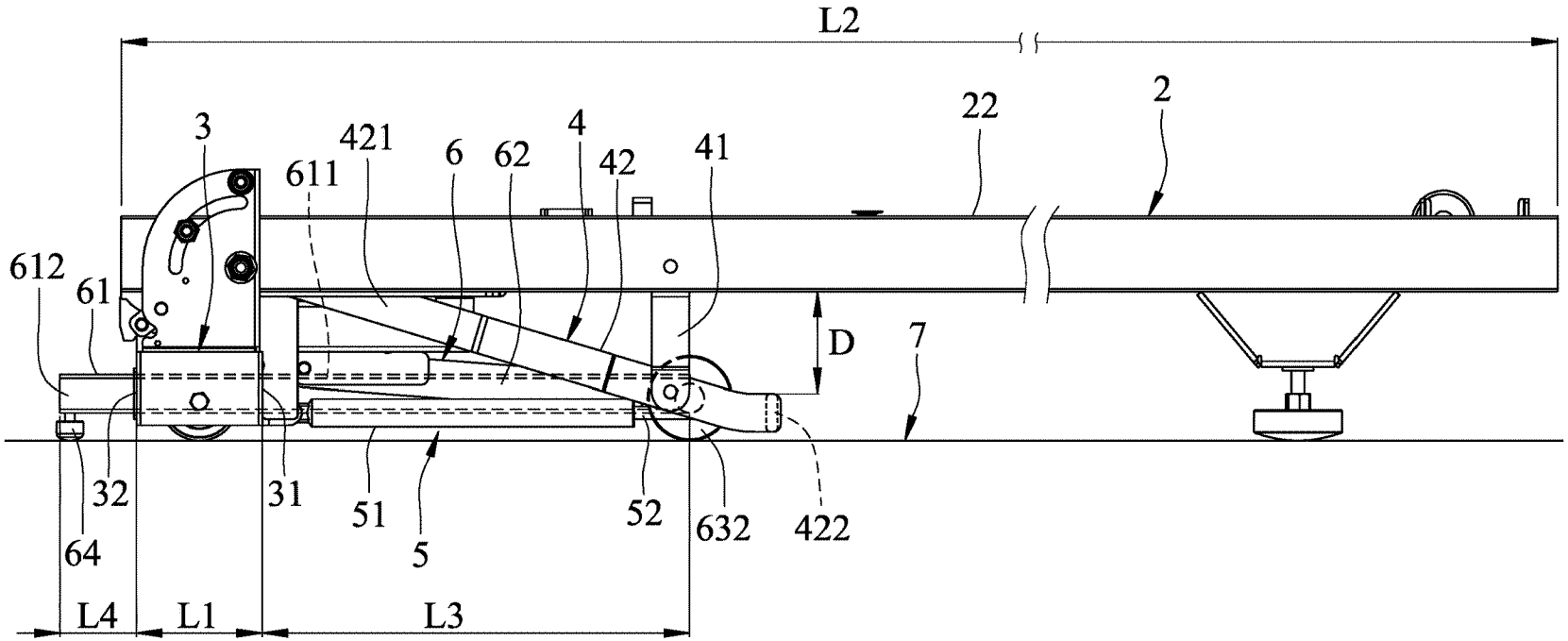
FIG. 5 is a schematic side view of the treadmill in the reclined position in accordance with the present invention.

The base frame 3 is placed on a supporting surface 7 (see FIG. 5) and extended along the extending direction of the short side 21 of the treadbase 2. Further, the base frame 3 is pivotally connected with the treadbase 2, and comprises two opposing lateral sides 31, 32. Further, the ratio between the length L1 of the base frame 3 in the direction of the long sides 22 of the treadbase 2 and the length L2 of the long sides 22 of the treadbase 2 is 1:20~24.

The linkage 4 is pivotally mounted between the treadbase 2 and the base frame 3, and comprises two first links 41 and one second link 42. The two first links 41 are respectively pivotally coupled between the second link 42 and the two long sides 22 of the treadbase 2. In the present preferred embodiment, the second link 42 is a substantially π-shaped rod member comprising two opposing side connecting portions 421 respectively pivotally connected with the first links 41, and a transverse connecting portion 422 connected between the two opposing side connecting portions 421 remote from the first links 41 and spaced from the long sides 22 of the treadbase 2 a predetermined gap D.

The retracting device 5 in the present preferred embodiment can be an air cylinder or hydraulic cylinder, comprising a pivot connection member 51 pivotally connected to one lateral side 31 of the base frame 3 and a retracting member 52 pivotally connected with the transverse connecting portion 422 of the second link 42. The retracting member 52 is movable relative to the pivot connection member 51 between a retracted position (see FIG. 4 and FIG. 5) and an extended position (see FIG. 6 and FIG. 7).

The supporting apparatus 6 comprises a supporting shaft 61, a connection rod 62, a roller set 63, and cushion means 64 (the cushion means can be a cushion block or cushion roller).

The supporting shaft 61 is slidably inserted through the two opposing lateral sides 31, 32 of the base frame 3 in the direction of the long sides 22 of the treadbase 2, and comprises a first supporting section 611 extended out of one lateral side 31 of the base frame 3 adjacent to the retracting device 5 and an opposing second supporting section 612 extended out of the other (e.g., outer) lateral side 32 of the base frame 3.

The connection rod 62 is pivotally connected to the treadbase 2 and the first supporting section 611 of the supporting shaft 61, and thus, the supporting shaft 61 is interlockable with the treadbase 2 by means of the first supporting section 611.

The roller set 63 is mounted on the supporting shaft 61 and slidably supported on the supporting surface 7, and comprises a roller axle 631 mounted at the first supporting section 611 of the supporting shaft 61 and two rollers 632 respectively rotatably mounted on two opposite ends of the roller axle 631 for rollably supporting the supporting shaft 61 when the supporting shaft 61 is moved.

The cushion means 64 is mounted at the second supporting section 612 of the supporting shaft 61 and configured for further supporting the treadmill on the supporting surface 7.

Referring to FIG. 4 and FIG. 5 again, when the retracting member 52 is placed in the retracted position, the long sides 22 of the treadbase 2 are kept in proximity to the supporting surface 7 and extended in the transverse (horizontal) direction, e.g., parallel to the supporting surface 7. At this time, due to such position, the length of the retracting member 52 of the retracting device 5 becomes relatively shorter; and the side connecting portion 422 of the second link 42 of the linkage 4 is dragged by the retracting member 52 to enlarge the gap D.

Additionally, when the long sides 22 of the treadbase 2 are moved into this position in proximity to the supporting surface 7, the supporting shaft 61 of the supporting apparatus 6 causes the connection rod 62 to move toward the side connecting portion 422 of the second link 42 of the linkage 4. At this time, the length L3 of the first supporting section 611 becomes greater than the length L4 of the second supporting section 612 by the sliding of the supporting shaft 61 through the base frame 3. Because the relatively longer first supporting section 611 and the treadbase 2 are disposed at the same lateral side 32 relative to the base frame 3, the first supporting section 611 of the supporting shaft 61 gives steady support to the treadbase 2.

Figure 6:
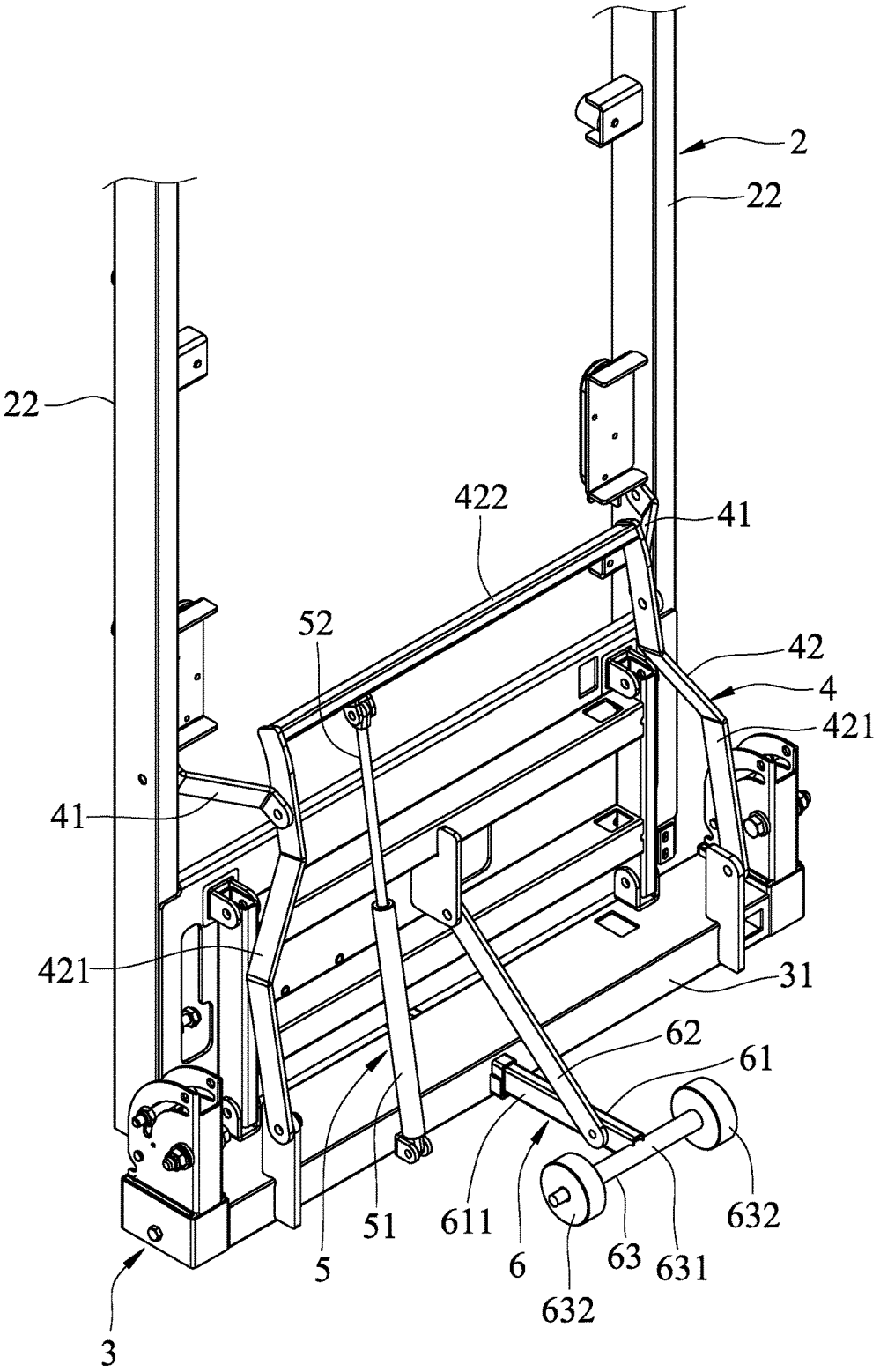
FIG. 6 is a perspective view of a part of the treadmill in accordance with the present invention, illustrating the relationship between the supporting apparatus and the treadmill in the upright position.
Figure 7:
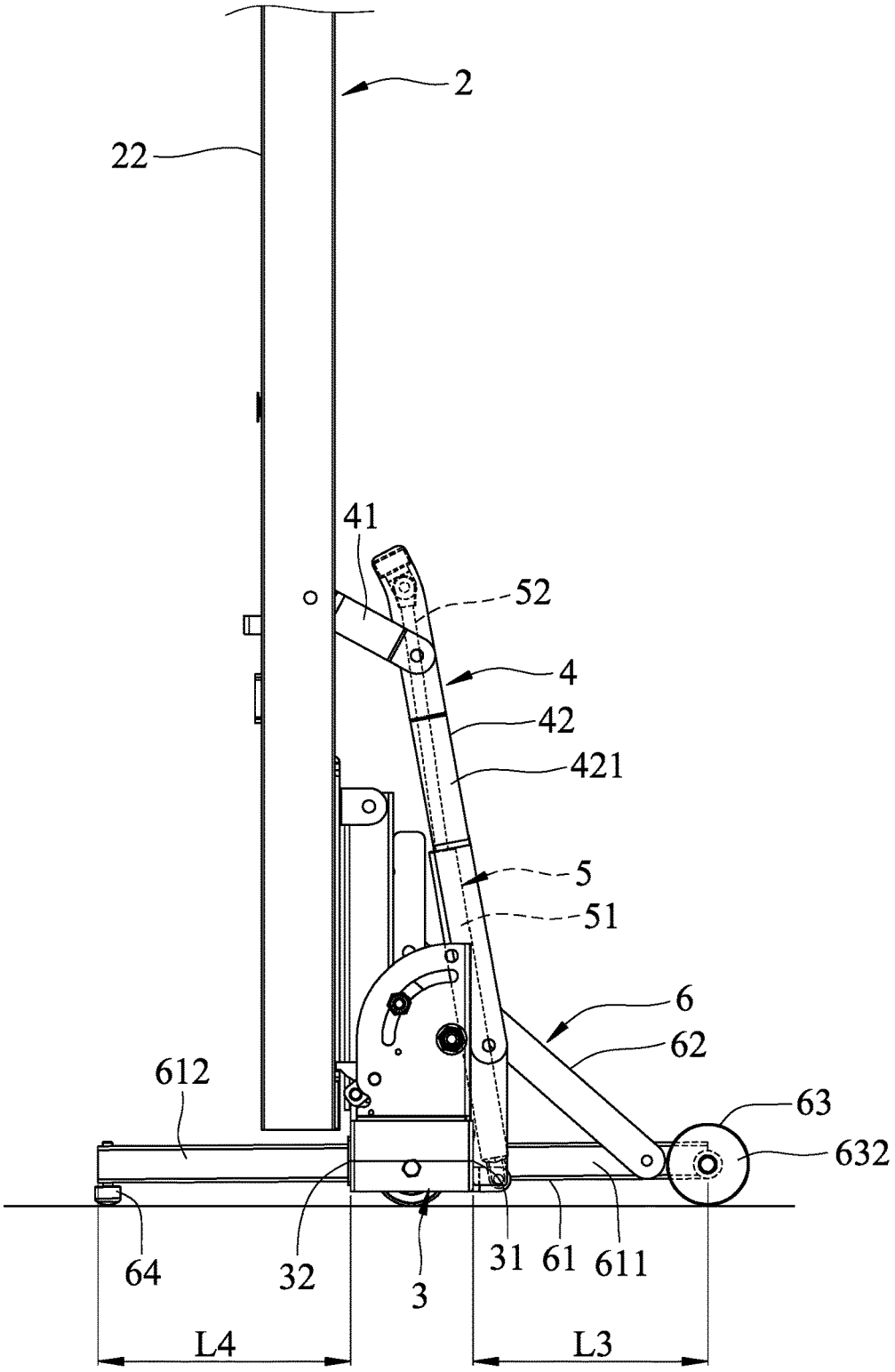
FIG. 7 is a schematic side view of the treadmill in the upright position in accordance with the present invention.

Referring to FIG. 6 and FIG. 7, when the retracting member 52 is in the extended position, the long sides 22 of the treadbase 2 are kept far away from the supporting surface 7 and extended in the longitudinal (vertical) direction, e.g., perpendicular to the supporting surface 7. At this time, due to this position, the length of the retracting member 52 of the retracting device 5 becomes relatively longer, and the side connecting portion 422 of the second link 42 of the linkage 4 is pushed by the retracting member 52 to shorten the gap D.

When the long sides 22 of the treadbase 2 are moved into this position away from the supporting surface 7, the connection rod 62 of the supporting apparatus 6 is caused to carry the supporting shaft 61 in direction away from the side connecting portion 422 of the second link 42 of the linkage 4. At this time, the length L4 of the second supporting section 612 becomes greater than the length L3 of the first supporting section 611 by the sliding of the supporting shaft through the base frame 3 and, the treadbase 2 is vertically supported on the base frame 3 with the center of gravity thereof located somewhat closer to the outer lateral side 32 of the base frame 3. Because the relatively longer second supporting section 612 is disposed adjacent to the lateral side 32 of the base frame 3, the supporting shaft 61 gives steady support to the treadbase 2.

Figure 1:
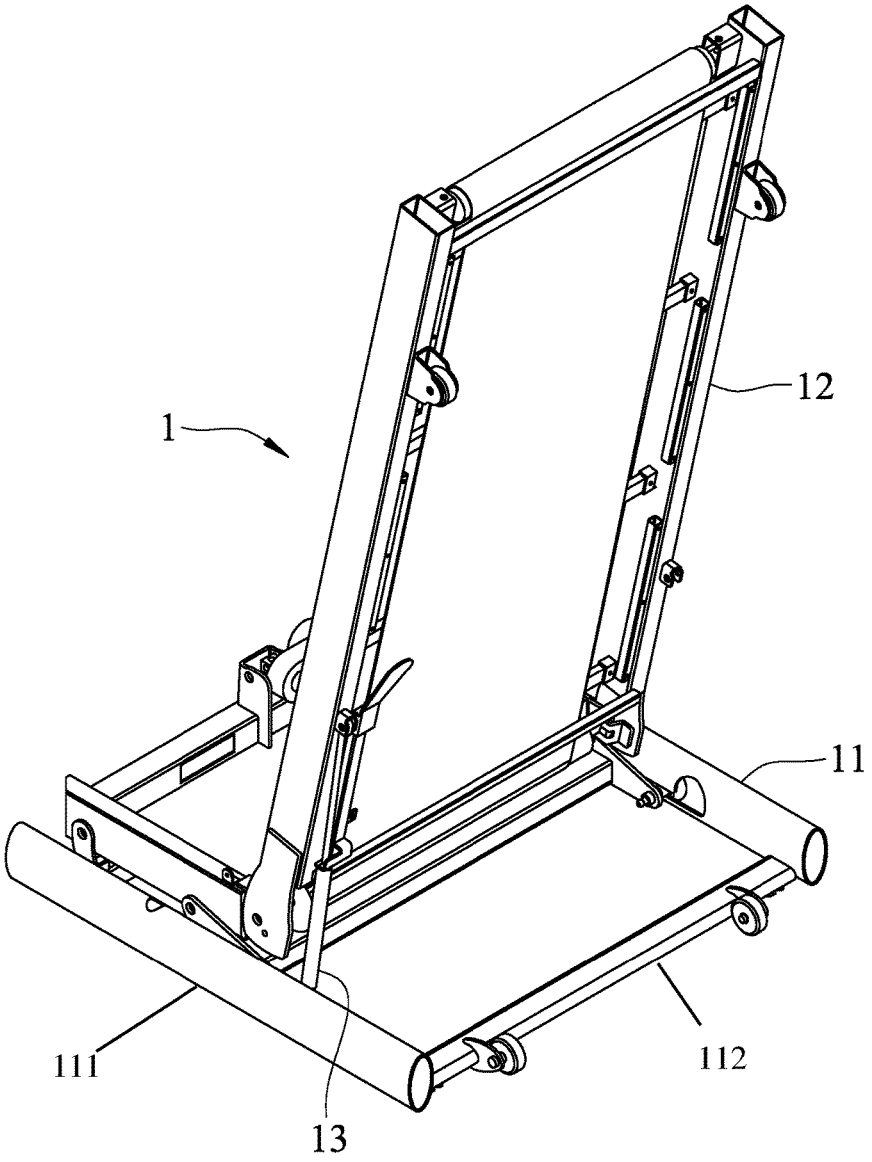
FIG.1 (PRIOR ART)
FIG. 1 is an elevational view of a treadmill configured according to Taiwan Patent M316743.

Through the above description, we can summarize the advantages of the present invention as follows:

The invention enables the length of the part of the first and second supporting sections 611, 612 of the supporting shaft 61 that is extended out of the base frame 3 to be changed with the biasing of the treadbase 2 relative to the base frame 3 to achieve the effect of supporting the base frame 3 and the treadbase 2, to enhance the stability when using or folding the treadmill. Further, because the supporting shaft 61 is a narrow elongated member without occupying much installation space, it is practical for use either with the base frame 3 shown in FIGS. 2-7 or the base frame 11 shown in FIG. 1 without protruding over the periphery of the treadbase 2. Thus, the invention significantly enhances the effectiveness of utilizing space.

Although a particular embodiment of the invention has been described in detail for purposes of illustration, various modifications and enhancements may be made without departing from the spirit and scope of the invention. Accordingly, the invention is not to be limited except as by the appended claims.

What is claimed is:

1. A supporting apparatus used in a treadmill, the treadmill comprising a base frame configured to be placed on a supporting surface, a treadbase pivotally mounted at said base frame and biasable relative to said base frame between a reclined position where said treadbase is disposed in proximity to said supporting surface and an upright position where said treadbase is kept away from said supporting surface and a linkage coupled between said treadbase and said base frame, the supporting apparatus comprising:

a supporting shaft inserted through lateral sides of said base frame and slidable relative to said base frame and interlocking with said treadbase, said supporting shaft comprising a first supporting section, which is configured to be disposed with said treadbase in said reclined position at one of the lateral sides relative to said base frame and a second supporting section extended out of an opposing lateral side of the lateral sides of said base frame, wherein the supporting shaft is configured in a way such that a length of said first supporting section of said supporting shaft being greater than a length of said second supporting section when said treadbase is in said reclined position, and the length of said second supporting section being greater than the length of said first supporting section when said treadbase is in said upright position.

2. The supporting apparatus as claimed in claim 1, further comprising a connection rod pivotally connected between said treadbase and said supporting shaft for enabling said treadbase to be interlocked with said supporting shaft.

3. The supporting apparatus as claimed in claim 2, wherein the connection rod is pivotally connected between said treadbase and the first supporting section of the supporting shaft.

4. The supporting apparatus as claimed in claim 1, further comprising a roller set mounted on said supporting shaft and slidably supported on said supporting surface.

5. The supporting apparatus as claimed in claim 4, wherein said roller set comprises a roller axle mounted at said first supporting section of said supporting shaft, and two rollers respectively rotatably mounted on two opposite ends of said roller axle and adapted for supporting said supporting shaft on said supporting surface.

6. The supporting apparatus as claimed in claim 1, further comprising a cushion means mounted at said second supporting section of said supporting shaft and adapted for supporting said supporting shaft on said supporting surface.

* * * * *